US011927417B2

(12) United States Patent
Kroyer et al.

(10) Patent No.: US 11,927,417 B2
(45) Date of Patent: Mar. 12, 2024

(54) FIREARM WITH GAS DRIVE

(71) Applicant: GLOCK TECHNOLOGY GMBH, Ferlach (AT)

(72) Inventors: Josef Kroyer, Zemendorf (AT); Elmar Bilgeri, Klagenfurt (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 157 days.

(21) Appl. No.: 17/754,237

(22) PCT Filed: Oct. 1, 2020

(86) PCT No.: PCT/EP2020/077508

§ 371 (c)(1),
(2) Date: Mar. 28, 2022

(87) PCT Pub. No.: WO2021/064097

PCT Pub. Date: Apr. 8, 2021

(65) Prior Publication Data

US 2022/0364807 A1 Nov. 17, 2022

(30) Foreign Application Priority Data

Oct. 4, 2019 (EP) ..... 19201441

(51) Int. Cl.
*F41A 5/20* (2006.01)
*F41A 5/28* (2006.01)

(52) U.S. Cl.
CPC . *F41A 5/20* (2013.01); *F41A 5/28* (2013.01)

(58) Field of Classification Search
CPC ..... F41A 5/20; F41A 5/26; F41A 5/28
USPC ..... 89/191.01–193
See application file for complete search history.

(56) References Cited

U.S. PATENT DOCUMENTS 834,753 A 10/1906 Reifgraber
2,628,536 A * 2/1953 Schaich ..... F41A 3/44 89/137
2,956,481 A * 10/1960 Barr ..... F41A 19/03 89/129.01
3,988,964 A * 11/1976 Moore ..... F41A 5/28 89/193

(Continued)

FOREIGN PATENT DOCUMENTS

DE 102017002165 A1 9/2018
EP 0272248 A2 6/1988

(Continued)

*Primary Examiner* — Joshua E Freeman
*Assistant Examiner* — Benjamin S Gomberg
(74) *Attorney, Agent, or Firm* — Raven Patents, LLC; Anton E. Skaugset

(57) ABSTRACT

A firearm including a gas drive, having an annular piston which is displaceably arranged on the barrel to form an expansion chamber between two end positions. At least one gas port penetrates the wall of the barrel in the region of the expansion chamber and a selector is provided. In order to provide a simple and easily adjustable mechanism, the expansion chamber is delimited by a ring surface and an inner cylinder surface of the piston, an end surface of the selector and the barrel. The selector is rotatably arranged on the barrel with at least two predefined rest positions. In each rest position, the gas flow from the expansion chamber is delimitable by at least one selector opening formed on the selector.

22 Claims, 9 Drawing Sheets

(56) References Cited

U.S. PATENT DOCUMENTS

| | | | | |
|---|---|---|---|---|
| 4,279,191 | A * | 7/1981 | Johansson | F41A 21/484 89/196 |
| 7,891,284 | B1 | 2/2011 | Barrett | |
| 8,596,185 | B1 * | 12/2013 | Soong | F41A 5/28 89/193 |
| 8,640,598 | B1 | 2/2014 | Jackson | |
| 8,752,471 | B2 | 6/2014 | O'Brien | |
| 9,921,022 | B1 * | 3/2018 | Noyce Merino | F41A 21/28 |
| 2012/0167756 | A1 * | 7/2012 | Larue | F41A 21/28 89/193 |
| 2013/0291713 | A1 | 11/2013 | Zheng | |
| 2014/0076150 | A1 * | 3/2014 | Brinkmeyer | F41A 5/28 89/193 |
| 2016/0003566 | A1 * | 1/2016 | Gomirato | F41A 5/28 89/193 |
| 2018/0172376 | A1 | 6/2018 | Alexander | |
| 2018/0180370 | A1 * | 6/2018 | Zheng | F41A 5/28 |
| 2019/0226776 | A1 * | 7/2019 | DiChario | F41A 3/26 |
| 2022/0299282 | A1 * | 9/2022 | Tasyagan | F41A 5/28 |
| 2023/0160648 | A1 * | 5/2023 | Schrödl | F41A 5/28 89/193 |

FOREIGN PATENT DOCUMENTS

| | | | |
|---|---|---|---|
| EP | 1162427 | A1 | 12/2001 |
| WO | 2016004294 | A1 | 1/2016 |

* cited by examiner

FIREARM WITH GAS DRIVE

TECHNICAL FIELD

The present disclosure relates to a firearms, and in particular to firearms having a gas drive, particularly rifles.

BACKGROUND

There are numerous firearms with different gas drives in the prior art, the aim of which is always—in conjunction with various springs—to use the propellant gases that drive the projectile to open the breech, to eject the empty cartridge case and to insert the next cartridge from the magazine to re-close and lock the breech and cock the firing pin mechanism.

For this purpose, it is common to provide in the barrel at least one gas extraction hole through which the propellant gas is directed to a piston, which moves the breech back via a rod or a gas duct, locking lugs on the breech interacting with locking lugs on the barrel until the breech opens. After the propellant gas has escaped, the breech is brought forward again and locked by the action of a return spring. There are numerous proposals to make this easy-sounding sequence a reality:

EP 1 162 427 A1 discloses a gas drive for automatic or semi-automatic weapons having a gas cylinder which is provided with gas openings on its front side by means of a flange and is arranged about a tubular magazine in which the cartridges are arranged in alignment one behind the other in the direction of their longitudinal axis. A circular-ring-shaped valve is provided opposite the cylinder, is axially movable, and releases or closes the gas openings in a controlled manner. The valve is held in the closed position by a pre-loaded spring until the gas pressure overcomes the spring force at a predetermined level. As a result of this design, the moving mass is noticeably far away from the barrel axis and has all the associated disadvantages; such an arrangement is in no way usable for weapons with a separate magazine.

U.S. Pat. No. 8,752,471 proposes in a pistol with a fixed barrel to arrange the return spring concentrically with respect to the barrel axis about the barrel and the gas extraction hole(s) close to the barrel muzzle. The piston has the shape of a circular ring and rests against the inside of the barrel and against the outside of the barrel cover. In practice, especially for automatic weapons, this creates major problems with the heating of the barrel. Due to the position of the gas extraction hole, which is located far to the front, the propellant gas is only supplied very briefly, because after the projectile has left the barrel, the supply is terminated by pressure equalization in the barrel.

U.S. Pat. No. 834,753, dating from 1904, proposes a gas extraction hole for a pistol having an axially displaceable barrel, which can be more or less aligned with a hole in the annular piston as desired and acts as a kind of adjustable valve. This regulates the energy acting on the moving barrel. The risk of soiling and the difficulty of cleaning make this idea unsuitable for automatic weapons used in harsh outdoor environments.

EP 272 248 discloses a long-stroke gas drive having a true sleeve piston and return spring arranged about the barrel. The guiding is performed on the barrel, which is provided with annular grooves to reduce friction and having the effect of a labyrinth seal. In this way, the propellant gases act over a much larger part of the long path of the piston than is the case with other weapons. In many cases, however, it is precisely this long displacement path of a part having a considerable mass that is disadvantageous.

U.S. Pat. No. 8,640,598, generally intended for firearms, proposes that in order to avoid bucking of the weapon, the longitudinally movable parts should be designed with as little mass as possible, and this is achieved in an embodiment having two operating rods arranged symmetrically on the left and right of the barrel, which connect the piston to the breech. In this case, a degassing opening is provided in the outer wall of the cylinder of the gas drive, and, when it overflows, the piston quickly loses its drive and continues to move only as a result of inertia. The backs of the operating rods are surrounded by springs, which move them forward again. The movement of the breech is caused by its own spring.

U.S. Pat. No. 7,891,284, like U.S. Pat. No. 8,596,185, has a regulating device for the passage of gas in the supply line for the propellant gas between the gas extraction hole and the inlet opening to the cylinder; even though this allows precise adaptation to the ammunition used, it poses a problem for operational safety because of the light soiling of this delicate part, which is made up of a plurality of small-format components.

DE 10 2017 002 165 describes its own gas drive with short stroke including its mounting elements on the barrel, the adjustability of the effective drive energy being effected by rotating a gas adjustment bushing at the outlet of the propellant gas. The necessarily eccentric arrangement with respect to the barrel axis and the numerous components required are the disadvantages of this solution.

In principle, it should also be noted that there is a difference between long-stroke gas drives, as described in EP 272 248 and having path lengths for the most part over 45 mm, and short-stroke ones, as described in DE 10 2017 002 165 and having path lengths for the most part less than 25 mm. The former have the problem of having to move relatively large masses over long distances, the latter the problem of having to transmit sufficient energy over a short distance; path lengths in between are not common.

U.S. Pat. Nos. 8,752,471; 834,753; 8,640,598; 8,640,598; 7,891,284 and 8,596,185 are hereby incorporated by reference for any and all purposes.

What is needed is a gas drive which, in addition to the simplest possible construction and high reliability, has an easily adjustable gas adjustment device, and provides symmetrical power transmission from the gas drive to the breech mechanism in order to reduce torque on the weapon.

SUMMARY

The present disclosure is directed firearms having a gas drive that is highly reliable, simple to manufacture, easily adjustable, and provides symmetrical power transmission to the breech mechanism.

In one example, the disclosure includes firearms including a frame; a barrel having a barrel axis, the barrel being fixedly mounted to the frame; a barrel extension that is connectable to the barrel; a breech having a sliding piece; and a gas drive configured to act on the sliding piece of the breech via one or more operating rods. The gas drive, in turn, includes a selector, the selector being arranged on the barrel so as to be rotatable about the barrel; an annular piston that is displaceably arranged on the barrel to form an expansion chamber between a front resting position and a rear end position, the expansion chamber being delimited by a ring surface and an inner cylinder surface of the annular piston, and an end surface of the selector and the barrel; where the annular piston is urged in a forward direction by one or more retaining springs; and at least one gas port defined in a wall of the barrel in a region of the expansion chamber; where the selector is rotatable about the barrel axis into at least two predefined rest positions, in which for each rest position a gas flow from the expansion chamber into an environment is delimitable by at least one selector opening defined by the selector and a gas outlet channel of the piston.

BRIEF DESCRIPTION OF THE DRAWINGS

The gas drives of the present disclosure are explained in more detail below with reference to the drawings.

DETAILED DESCRIPTION

Figure 1:
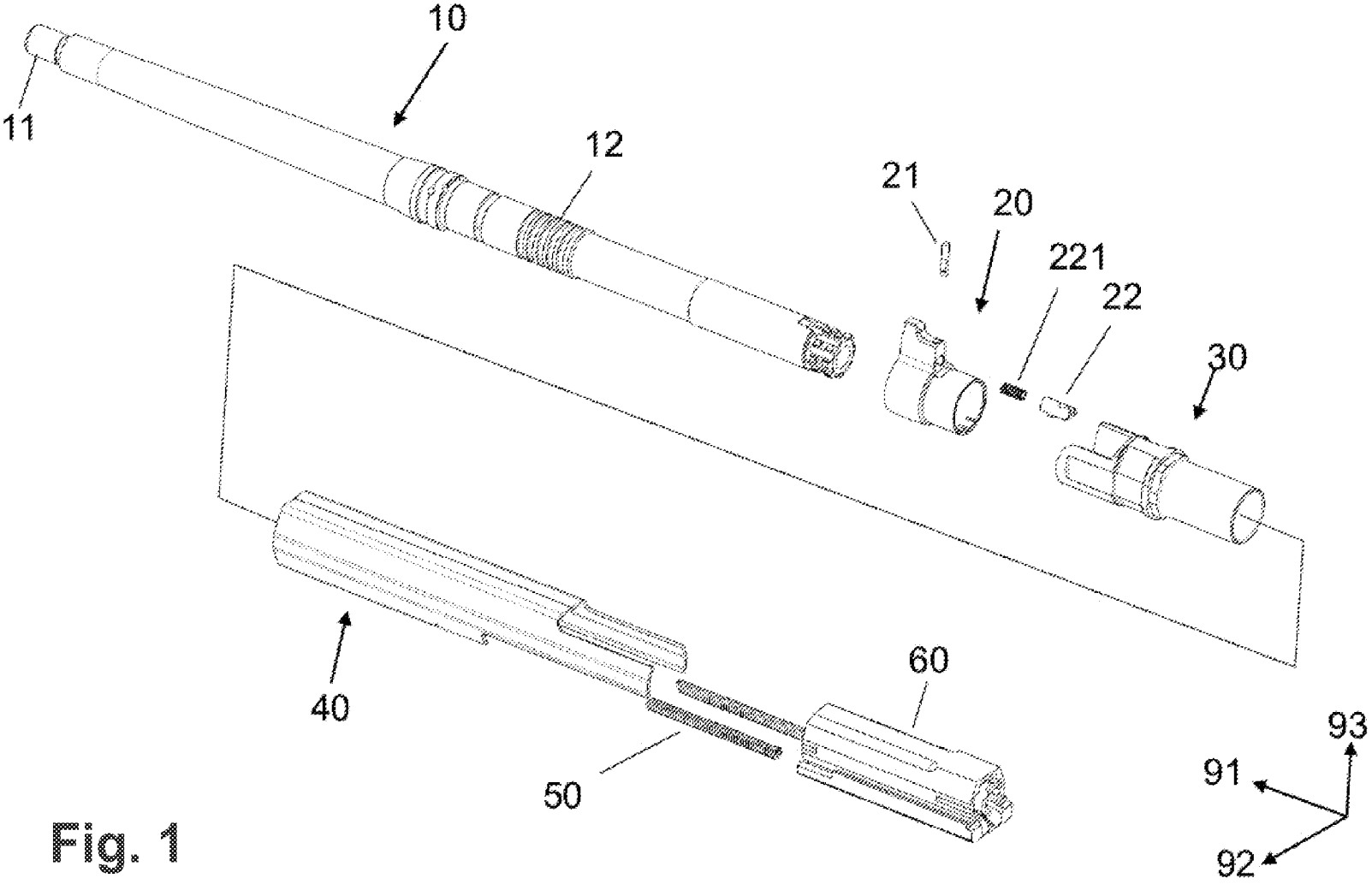
FIG. 1 is an exploded view of the barrel of a firearm with an exemplary gas drive and barrel extension, according to the present disclosure.

As used herein, the terms "front" or "rear" etc. have the usual meaning that the muzzle of the barrel is "front" and the end of the stock is "rear," that the magazine, if present, is "down," that the trigger is "under" the barrel, the projectile flies "forward," etc.

A Cartesian coordinate system, which is only used for orientation, is shown in each of the figures. The arrow 91 points "forward" in the direction of the barrel muzzle, the arrow 93 points "upward" and the arrow 93 points "left," each with regard to the illustrated components of the weapon; the arrows 91-93, when 91 coincides with the axis of the barrel bore, span a weapon center plane that can be viewed cum grano salis as the plane of symmetry of the weapon.

A generic firearm, such as a rifle, contains, for example, in a so-called "upper" at least: a barrel, in some cases with a barrel extension, a breech mechanism, a firing pin mechanism, a gas mechanism and a cover. This upper is connected, preferably removably, to a "lower," which contains at least a grip stock, a magazine and a trigger mechanism. In the assembled, ready-to-fire state, the latter is in operative connection with the firing pin mechanism. The present disclosure relates to the design of a gas drive for a firearm.

As used herein, the term firearm may include handguns or long guns, without limitation. Where the term "rifle" is used, it includes various long-barreled firearms, including carbines, that include a gas drive. If a barrel extension is provided, it is counted below as part of the barrel and is not mentioned separately.

In an appropriate functional consideration, a rifle has a barrel with a barrel axis, a gas drive, a barrel extension, an upper housing, also usually called an "upper" mostly outside the USA, a carrier, a breech, a cocking slide, a forestock, a lower housing, also called a "lower," which in turn comprises a magazine holder, a trigger device, a grip stock and a breech catch device, a central lock for connecting the upper and lower, a magazine and a shaft. Furthermore, guides for the breech and/or the cocking slide can be provided in the upper housing.

It is not always necessary, especially in the case of pistols, to have all of these parts present, but other parts can also be added, for example mounting elements for telescopic sights, for laser pointers, and the like. It is also possible for some of the named components to be formed inseparably from one another on (or in) a more complex component.

Where a firearm includes a gas drive according to the present disclosure, the gas drive may include the following characteristics:

- has an annular piston arranged about the barrel,
- from the annular piston to the sliding piece of the breech, it has over most of its length, thus over 50% of the length, two, in some cases interconnected, operating rods symmetrical with respect to the weapon center plane and preferably having a longitudinally rectangular or longitudinally polygonal cross section;
- it is urged into its front resting position by two or more helical return springs arranged symmetrically with respect to the weapon center plane or to the barrel axis;
- a gas outlet is provided on its forward front above, beside and/or preferably below the barrel axis;
- the contact between the operating rod and the sliding piece is maintained until the control lugs of the sliding piece have axially left the control lugs of the barrel, if such control lugs are provided;
- an expansion chamber is formed between the barrel, piston and selector;
- the selector is arranged on the barrel so as to be rotatable about the barrel axis and is rotatable into at least two predefined rest positions;
- in a rest position, the gas flow from the expansion chamber out into the environment can be limited by at least one selector opening formed on the selector and a gas outlet channel of the piston.

The length of the presently disclosed gas drive is to be regarded as its axial extension from the front side (end face) of the annular piston to the rear end of the operating rods; the length of the operating rods may also include the portion at which they are connected to one another. The operating rods are also referred to in the plural when they are connected to one another (in one piece or otherwise) to indicate their arrangement with respect to the center plane of the weapon. Alternatively, the operating rods are functionally referred to as an operating rod assembly.

FIG. 1 shows an axial exploded view of a barrel 10 having a muzzle 11 and a labyrinth seal 12, a selector 20, a piston 30, two interconnected operating rods 40, associated retaining springs 50 which are supported on a barrel extension 60 firmly connected to the barrel, the operating rods 40 protruding past the barrel extension 60 to the rear in order to cooperate with a sliding piece or breech head carrier (not shown). The mode of operation of the operating rod assembly 40 and its transmission of force to the sliding piece can be found in European patent application EP19201441.3, the content of which is to be made part of the content of the present application here by reference.

Gas ports and a gas gap explained later can be seen on barrel 10; the rear end of the barrel is provided with lugs to interact with counter lugs for locking in a barrel of the weapon.

Figure 2A:
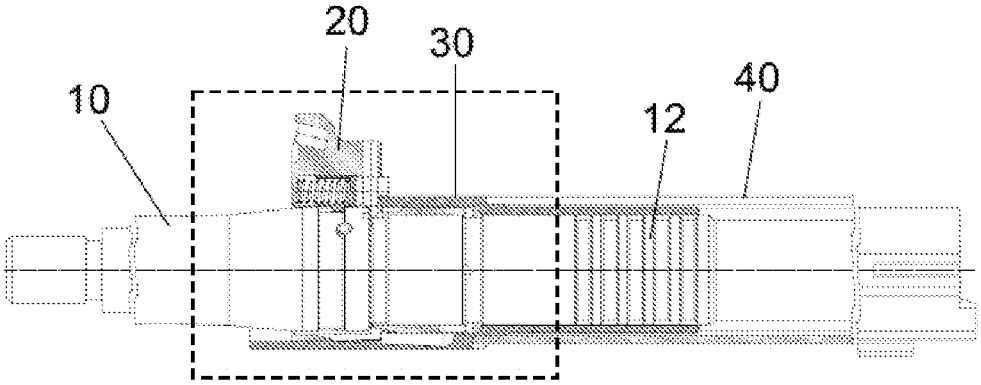
FIGS. 2A and 2B are sectional views along the axis of a selector according to the present disclosure in different scales.

The selector 20 is essentially annular and concentric to the axis of the barrel bore, as may be seen in FIG. 2A, and has a rest bolt 21 which is arranged in the radial direction to the axis of the barrel bore axis and which, as explained later, interacts with a plunger 22 which is under the action of a spring 221. The two components last-mentioned are accommodated in direction 91 in a recess of the selector 20. Preferably, all of them are arranged in the region of the radial protrusion of the selector 20 used for handling.

The selector 20 has a rear and a front portion, the rear portion having a smaller diameter than the front portion and the piston 30 in the resting position being pushed over the rear portion of the selector 20. At the rear portion of the selector 20, there is at least one selector opening 23 for adjusting the gas flow from the expansion chamber 28 into the gas outlet channel 32 of the piston 30, and the selector 20 in the transition region to the front portion has at least one exhaust 24 for letting the gas flow out of the gas outlet channel 32.

The piston 30 slides under the action of the propellant gases and the retaining springs 50 on the casing of the barrel 10 back into the rear end position and forward into the resting position and moves the operating rods 40 and via them the breech (not shown).

In this way, a relatively homogeneous arrangement of the moving masses about the axis of the barrel bore can be achieved and a force transmission to the breech that is symmetrical with respect to the barrel direction can be effected. This has the effect of reducing an eccentrically acting torque on the weapon or the shooter when firing a shot.

Figure 2B:
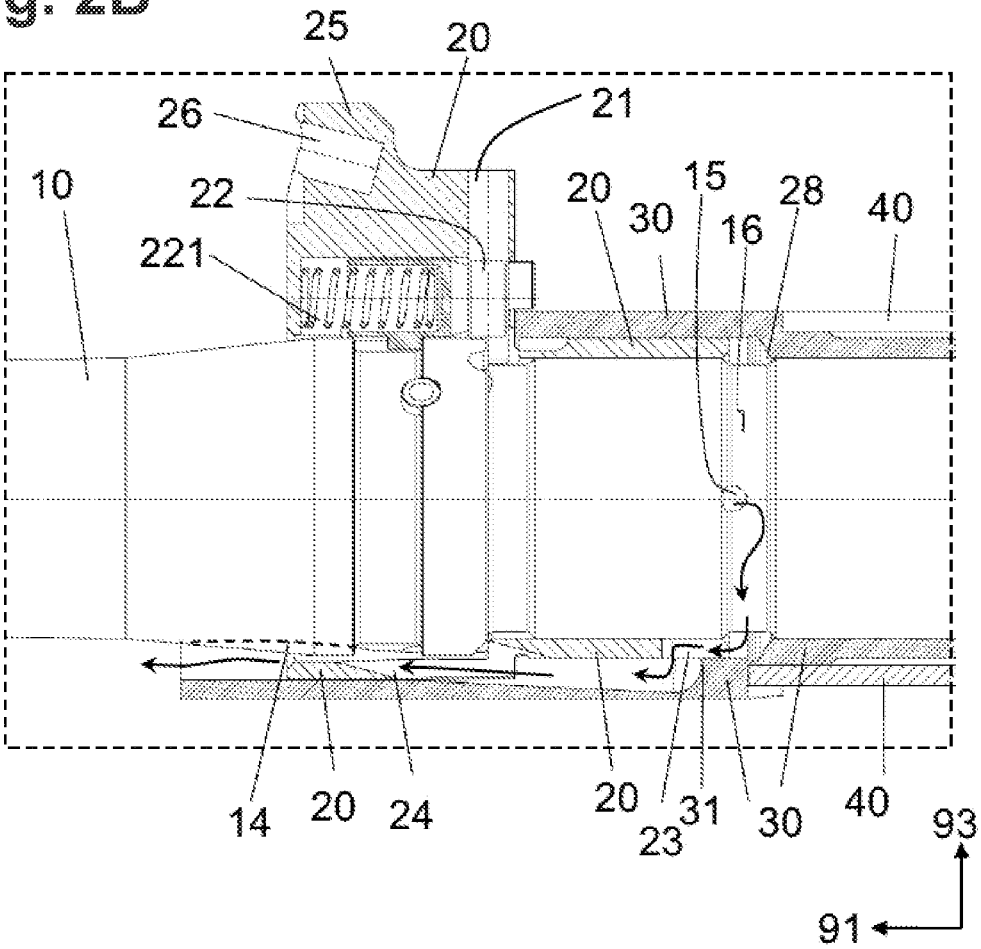
Figure 3A:
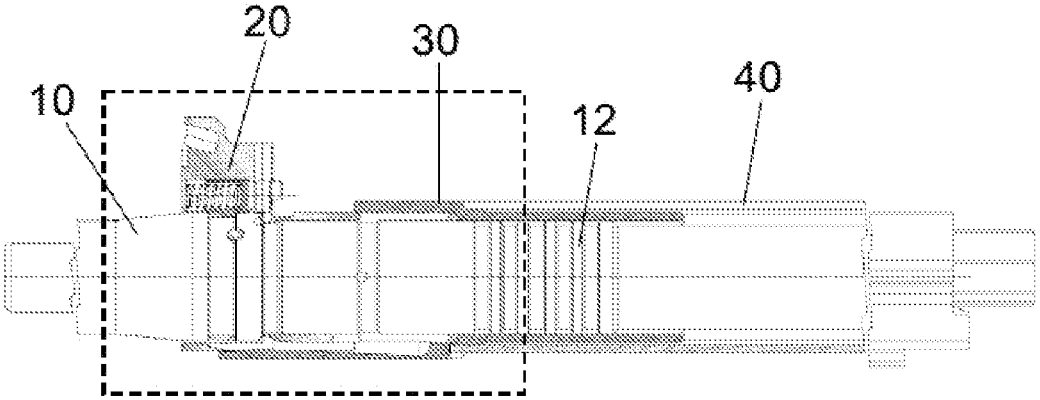
FIGS. 3A and 3B are sectional views according to FIGS. 2A and 2B in different positions.
Figure 3B:
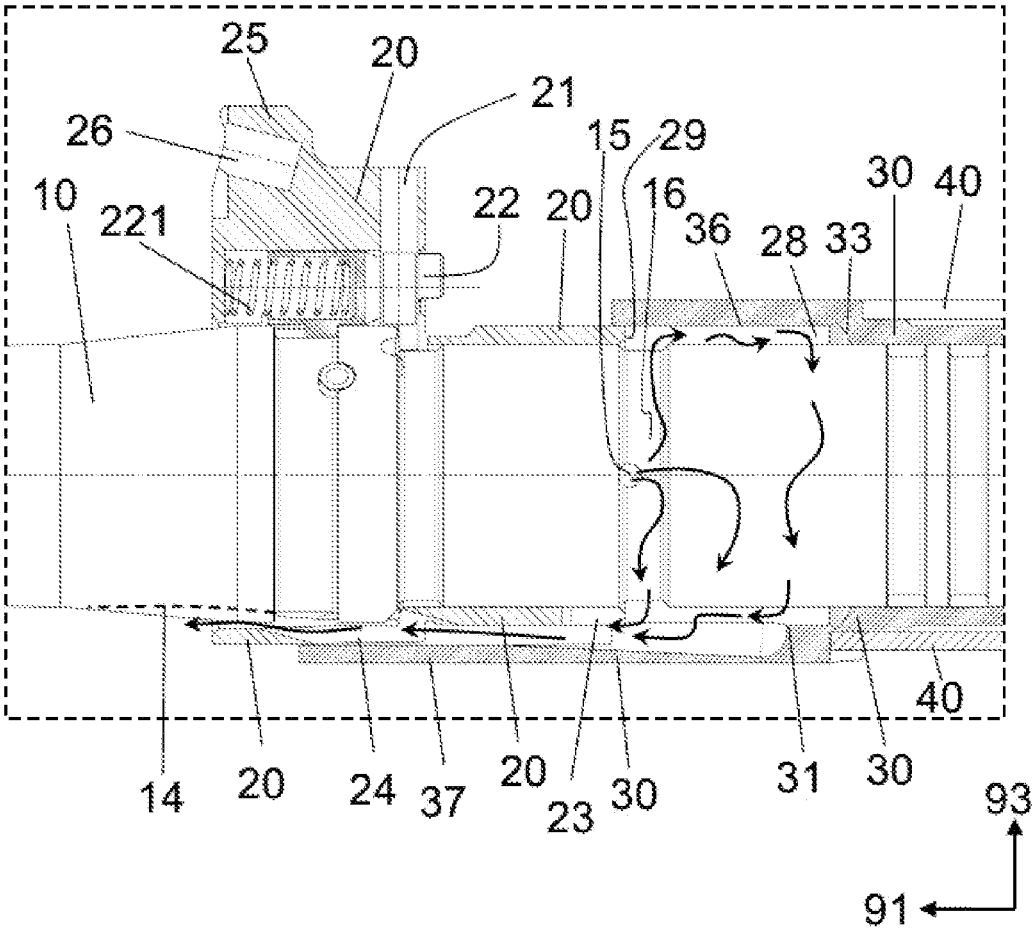
Figure 7A:
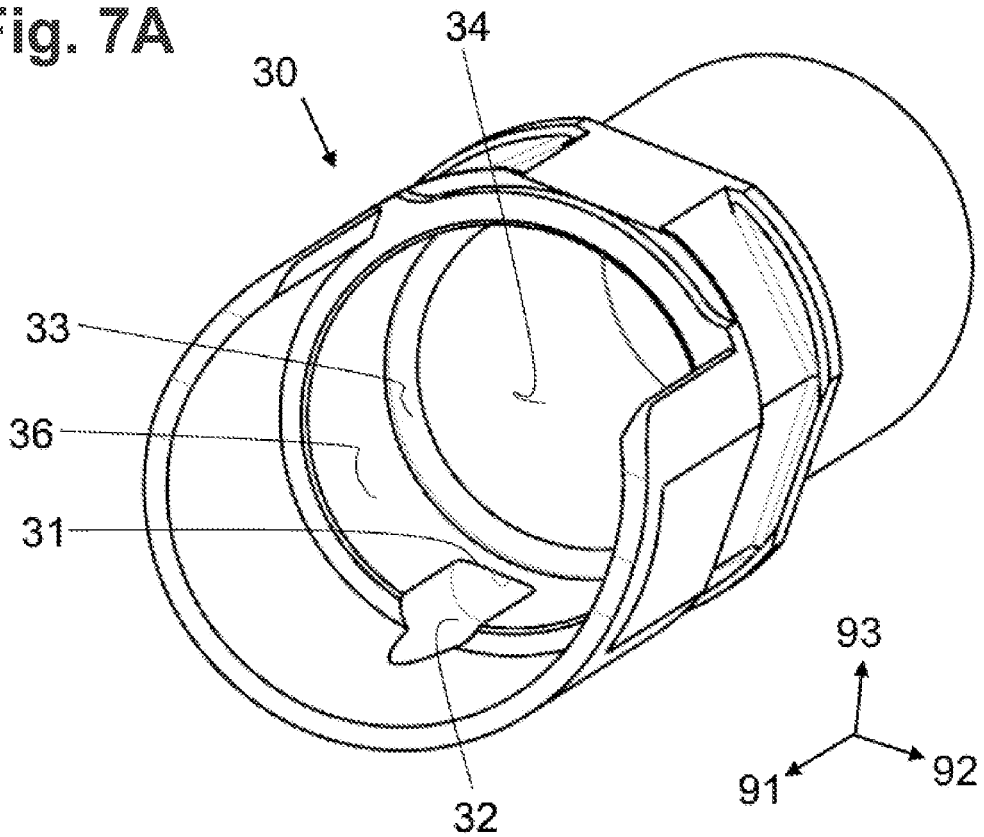
FIGS. 7A and 7B show a piston in different perspective views.

The basic functionality is as follows:

As is made clear when viewing together FIG. 2B (which is a detail of FIG. 2A in greater scale) and FIG. 3B (which is a detail of FIG. 3A in greater scale), which are partial section representations (the barrel is drawn in side view), gas from the barrel 10 flows out of at least one gas port, preferably out of two or more gas ports 15, which in any case are then symmetrically distributed about the circumference, into a gas gap 16 and into an expansion chamber 28 formed by the outer surface of barrel 10 and the inner surface of piston 30. It is delimited by a ring surface 33 of the piston 30, an inner cylinder surface 36 of the piston 30, the barrel 10 and an end surface 29 of the selector 20 (compare FIG. 7A and FIG. 3B). From there, after flowing over an overflow edge 31 of the piston 30, the gas passes through a selector opening 23 formed on the selector 20 into the gas outlet channel 32 and further through the exhaust 24 to the front in the barrel direction out into the environment. A recess 14 is designed as an elongated, groove-like depression (shown as a dashed line in FIG. 2B) in the barrel 10 and serves to let the gas out into the environment.

Figure 4:
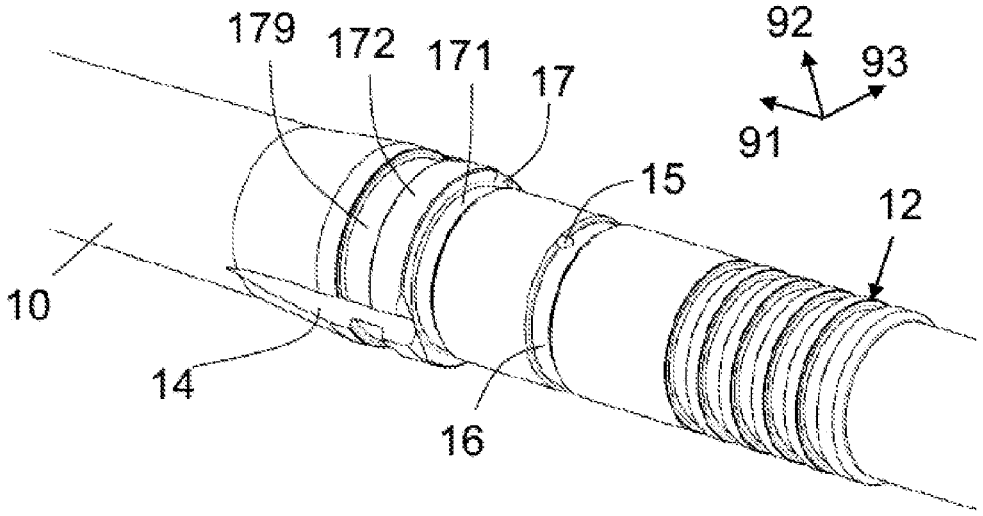
FIG. 4 is a perspective view of a piston obliquely from the rear.

In FIG. 4, the recess 14 can be seen well. The recess 14 is designed and arranged on the barrel 10 in such a way that it is fluidically connected to an exhaust 24 of the selector 20 in each of the presettable working positions, whereby the gas can in principle escape unhindered through the gas outlet channel 32 toward the front. For a better under-standing, a synopsis of FIGS. 2 and 3 are referenced at this point.

The volume of the expansion chamber 28 is increased by the gas pressure, as a result of which the piston 30 is moved from the front resting position (FIG. 2B) toward the rear into an end position (FIG. 3B). The piston 30 transmits the force of the retaining spring 50 acting counter to the direction 91 via a contact surface 35 (FIG. 7B) to the operating rod assembly 40. The selector 20 seals with its essentially cylindrical inner surface 270 (FIG. 6A) against the barrel 10, and with its cylindrical outer surface 271 (FIG. 6A) to the inner cylinder surface 36 (FIG. 3B) of the piston 30. The sealing surface 34 (FIG. 4A), an inner cylinder surface in the rear portion of the piston 30, seals the piston 30 against the barrel 10 or the labyrinth seal 12.

The piston 30 thus has a rear portion with an inner sealing surface 34 and a front portion with an inner cylinder surface 36 and gas outlet channel 32, as can be clearly seen in FIG. 7. At the transition from the rear to the front portion, the ring surface 33 is formed, preferably normal to the barrel axis. The gas outlet channel 32 is arranged on the inside of the piston 30 on the cylinder surface 36 and can be delimited at the rear by an overflow edge 31, which is arranged in front of the ring surface 33 as seen in the barrel direction. The width of the gas outlet channel in the circumferential direction is to be provided in such a way that a fluidic connection with the expansion chamber 28 through the preset selector opening 23 is possible. It has proven to be advantageous if the width of the gas outlet channel 32 covers an angular range from 5° to 90°, preferably from 10° to 30°, as viewed from the axis of the barrel bore, on the cylinder surface 36 of the piston 30.

As will be explained in more detail below, a protrusion 37 can be formed on the front portion which at least partially surrounds the selector 20 in the circumferential direction for guiding the gas forward. It has proven to be advantageous if the casing, starting from the center of the gas outlet channel 32, is at 90°, preferably 180°, particularly preferably more than 180°, in the circumferential direction as seen from the axis of the barrel bore; see for example FIG. 7A.

Figure 5:
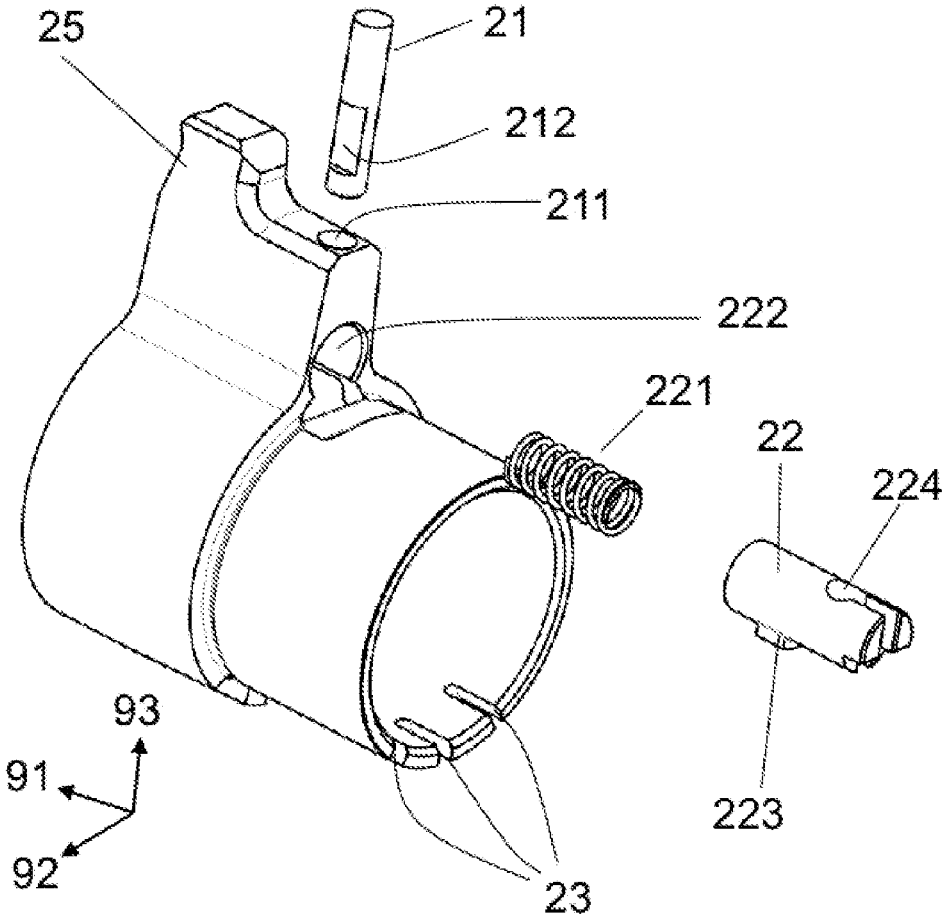
FIG. 5 shows an exemplary selector in perspective view, FIGS. 6A and 6B provide detailed views of the exemplary selector in different perspective views.

In FIGS. 5 and 6, an embodiment of a selector 20 according to the present disclosure is shown in detail in perspective views.

Figure 6A:
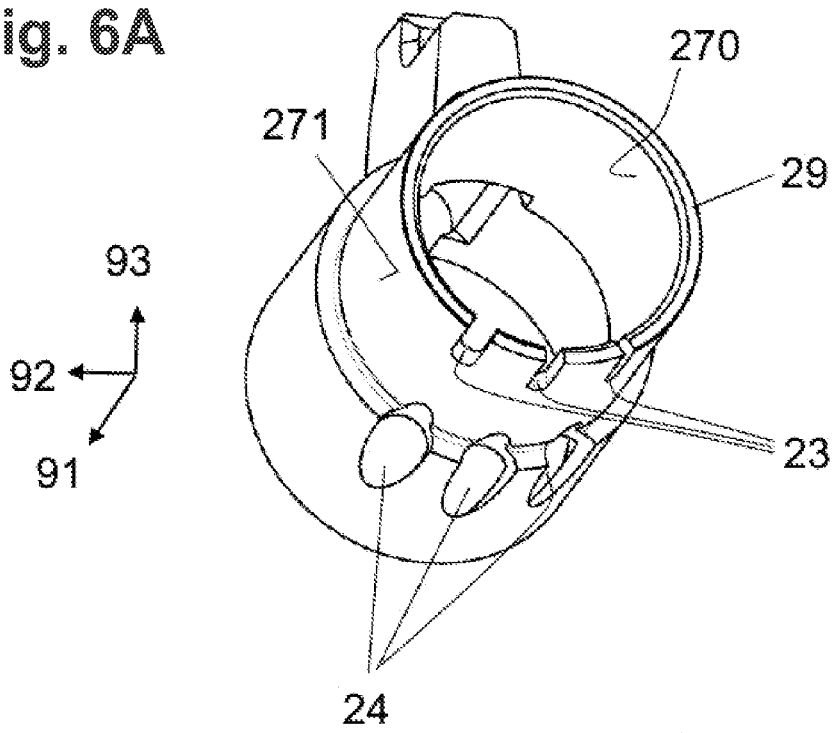
Figure 6B:
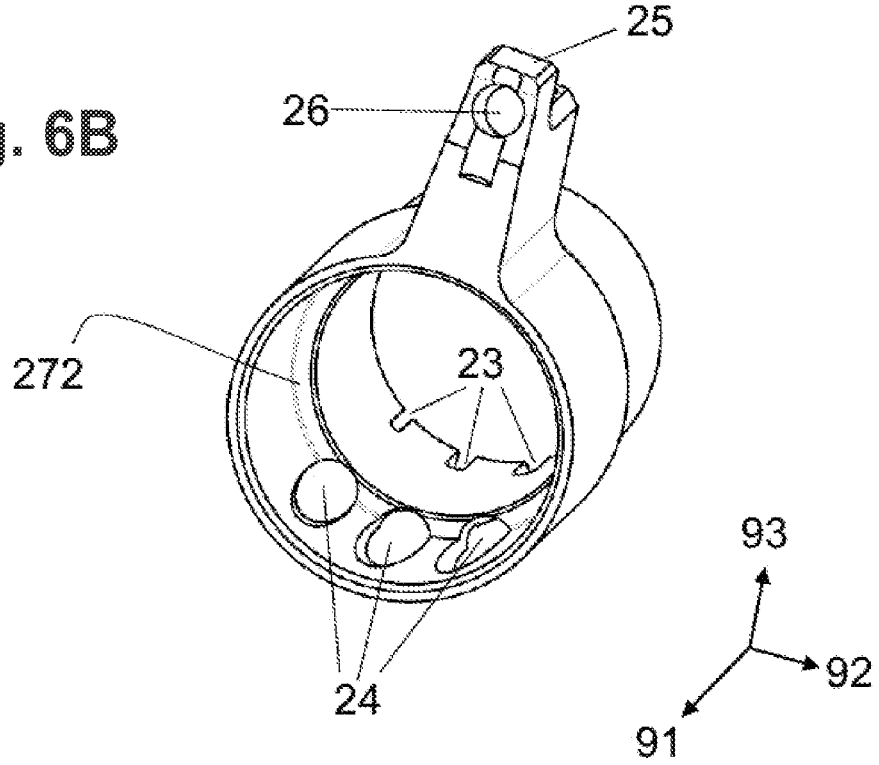
Figure 7B:
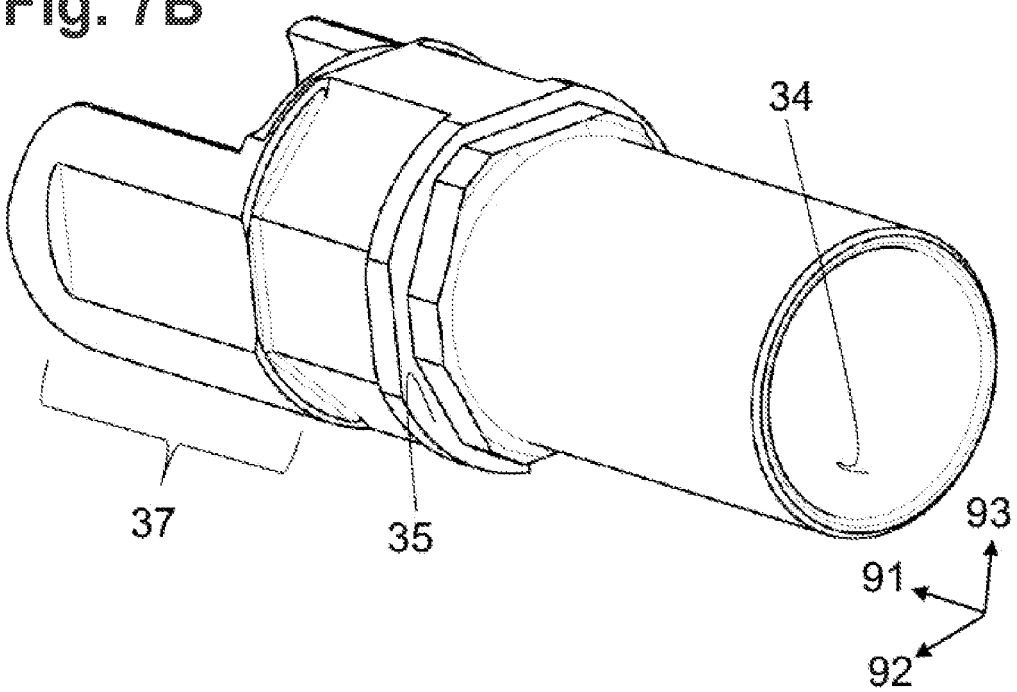

In FIGS. 5, 6A, and 6B, a selector 20 is shown which has a front portion facing the muzzle, the inner diameter of which is designed to be larger than the rear portion. The selector 20 comprises an operating element 25 which is designed to protrude radially on the front portion and which is designed for the simplest possible gripping or actuation of the selector 20. On the selector 20, an opening (rest bolt opening 211) extending radially inward in the direction of the barrel 10 is also provided which serves to receive a rest bolt 21. The selected views show the position of the rest bolt opening 211 within the operating element 25, although in principle alternative positions are also conceivable with knowledge of the present disclosure. The shape of the rest bolt 21 corresponds essentially to a rod or pin which has a flattening 212 on at least one side on the lateral surface.

Furthermore, it can be seen from FIG. 5 that the selector 20 has a spring opening 222 which is formed parallel to the axis of the barrel bore and whose opening points to the rear and serves to receive a spring 221 and a plunger 22. The plunger 22 is essentially cylindrical and—viewed in the installation situation—has a protruding cam 223 on its lower face. In addition, a slotted rest bolt receiver 224 is formed on the plunger 22 and serves to receive and guide the rest bolt 21 in the installation situation. The slit-shaped opening of the rest bolt receiver 224 runs from a hole for receiving the rest bolt 21 normal to the axis of the barrel bore to the rear up to the end of the plunger 22 and is dimensioned in the transverse direction to match the diameter of the rest bolt 21 in the region of its flattening 212.

In synopsis with FIG. 2, 3 and in particular FIG. 9, the installation situation and mode of operation of the plunger 22 interacting with the rest bolt 21 becomes clearer, and it is clearly visible that the rest bolt opening 211 crosses the spring opening 222 and thus allows contact of the inserted rest bolt 21 with the barrel 10.

Further views of the selector 20 are shown in FIGS. 6A and 6B. As already mentioned, in its axially rear portion it has an inner, cylindrical sealing surface 270 with which it is arranged on the barrel 10 so that it can rotate. At its rear end, three selector openings 23 are provided which are designed as notches of different sizes starting from the edge of the cylinder.

The sealing surface 270 is delimited by a step 272 in the direction of the front region of the selector 20; see FIG. 6B. In the transition region of the step 272, three, preferably equally large, exhausts 24 are provided which, in the assembled state, as can be seen in FIG. 2B, allow the propellant gas to flow forward past the barrel 10 and out into the environment. The front region of the selector 20 thus has a larger inside diameter than the rear region of the sealing surface 270.

Figure 8A:
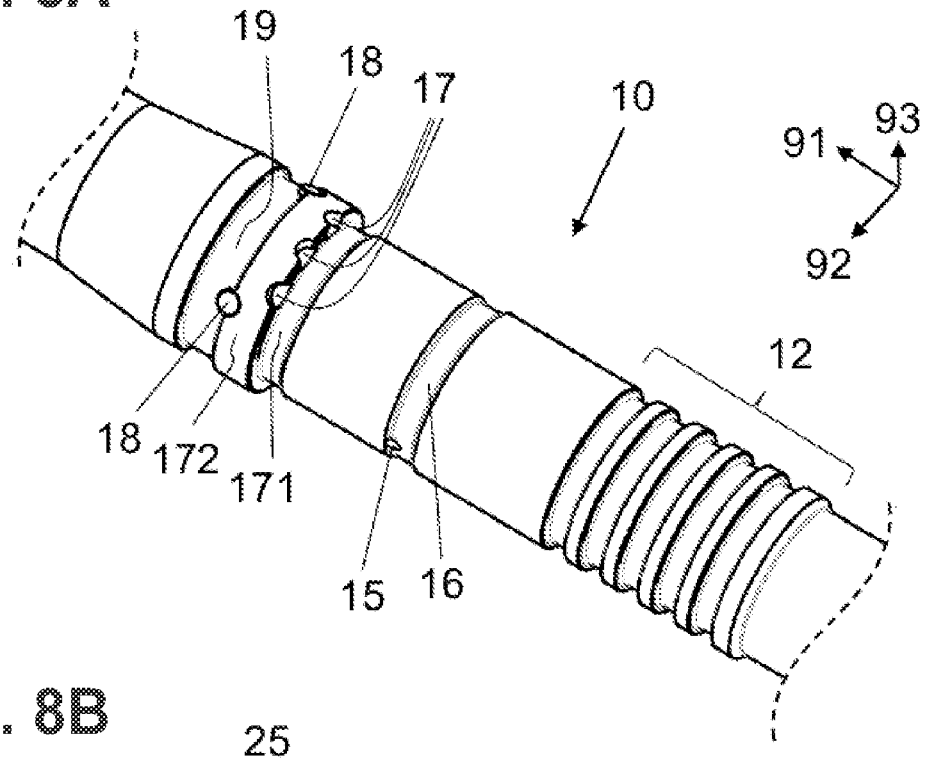
FIGS. 8A and 8B show the region of the barrel involved by the gas drive of the present disclosure and the mechanism without holder.
Figure 8B:
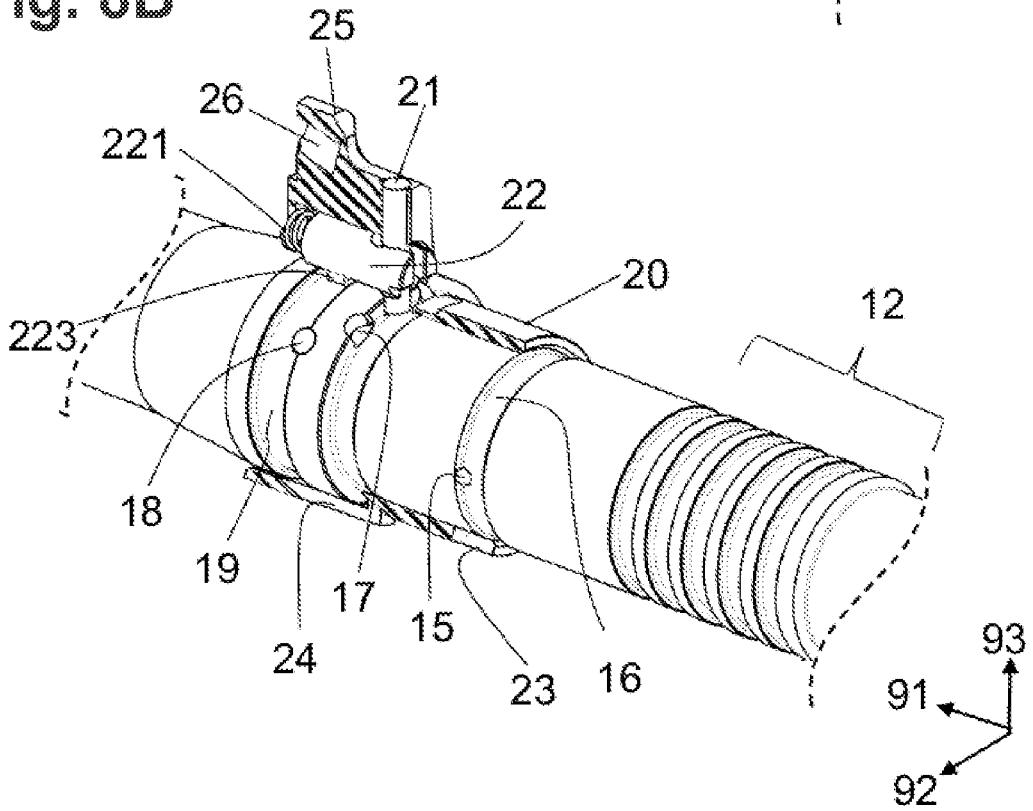
Figure 9A:
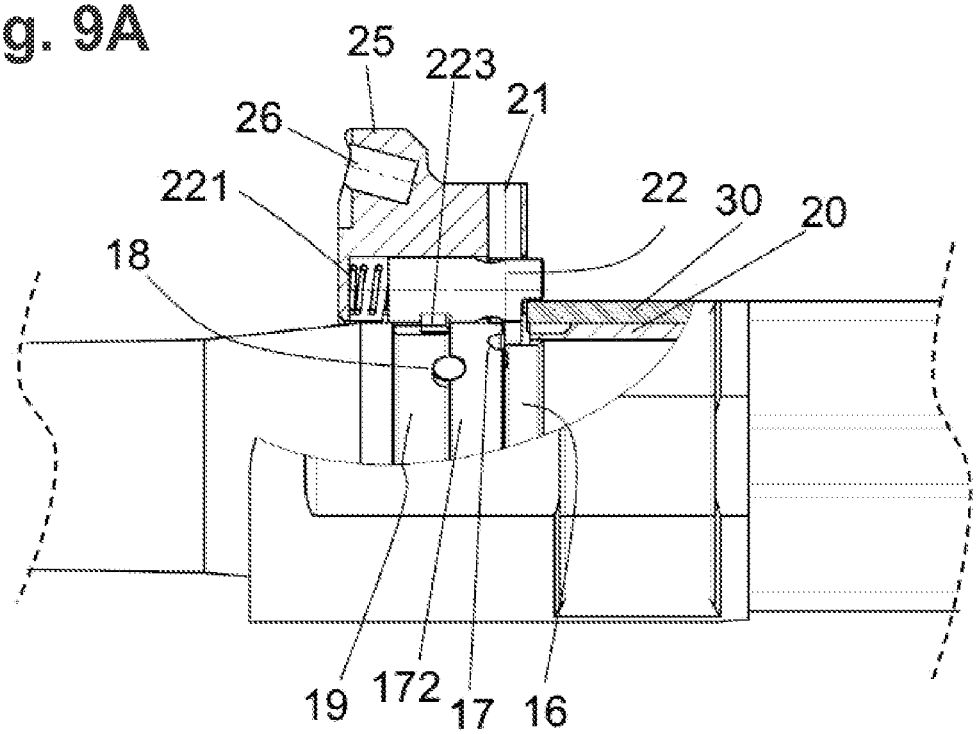
FIGS. 9A and 9B show an exemplary selector in the latched state in partial section, and during adjustment in partial section, respectively.

The mode of operation of the selector 20 is as follows:

Adjusting the selector 20 in the circumferential direction, i.e. rotating it about the axis of the barrel bore, causes a certain amount of gas to pass through the at least one selected selector opening 23 into the region of the gas outlet channel 32 of the piston 30 (FIG. 7A), covers it and thus limits the gas flow. Depending on the selected selector opening, more or less gas per unit of time (faster-slower) flows out of the expansion chamber and thus changes the force (magnitude and temporal progression) that acts on the operating rods 40. The presettable positions of the selector 20 thus limit the amount of gas available for actuating the breech. In order to be able to carry out the rotation in a controlled manner and to ensure that the selected position is maintained, the following mechanism is provided:

The rest mechanism:

As, can be clearly seen, in particular from a synopsis of FIGS. 8 and 9 (FIG. 8A shows the region of the barrel that is involved, FIG. 8B in a rotated position with the mechanism without its holder; FIG. 9A shows the selector in the latched state, 9B during the adjustment, each in partial section), the selector 20, which is pushed onto the barrel from the back to the front, has the already mentioned plunger 22, which is pre-loaded counter to the direction 91 by the spring 221. In the installed state or the resting position, a rearward movement of the selector 20 is limited by the selector 20 being held in position by the plunger 22 via the contact of the cam 223 with the flange-shaped band 172. Since the piston 30 is pre-loaded forward in the direction of the muzzle by the retaining springs 50, the selector 20 is also pushed forward. A further movement of the selector 20 forward beyond a presettable working position is prevented by the step 272, because it comes to rest against the band 172. In addition, the selector 20 is supported on the band 172 with the rest bolt 21 in corresponding recesses, hereinafter referred to as rest position 17. The cam 223, which corresponds to a radial protrusion of the approximately cylindrical plunger 22, also serves to guide the selector 20 in the circumferential direction in the stopper notch 19, which is formed in front of the band 172 of the barrel 10 in the barrel direction. It should be emphasized here that the plunger 22 remains in a presettable working position in the operating state and only during the adjustment process can be manually deflected against the force of the spring 221 and rotated in the circumferential direction.

For easier, in particular tool-free, actuation of the plunger 22, it is advantageous if the plunger 22 has a length such that, in the spring-loaded installation situation, the rear region protrudes a few millimeters rearward, preferably 2 to 20 mm, particularly preferably 5 to 10 mm, from the spring opening (222).

As described, in the resting position and also during operation, the rest bolt 21, which is fixedly mounted in the axial direction with respect to the selector 20, is pressed forward into the selected rest position 17 of the barrel (in the direction of the muzzle). When a shot is fired and during the gas pressure-operated reloading process, in which the piston 30 moves rearward toward the shaft, the rest bolt remains latched in the rest position 17 because the spring 221 secures the axial position of all the components of the gas extraction device.

Even in the partially disassembled state (for example, when the barrel 10 is removed from the housing, when the operating rod assembly and the piston 30 are removed), the selector 20 therefore remains connected to the barrel and remains in the selected position.

For the adjustment, the selector 20 is pressed rearward in the axial direction against the action of the spring 221, in the direction of the labyrinth seal 12, so that the rest bolt 21 comes out of the rest position 17. In the installed state, the piston 30 and with it the operating rods 40 are also moved slightly rearward, so that the force of the retaining springs 50 must also be overcome. In this axial position, the selector 20 can be rotated about the axis of the barrel bore. When it reaches the next rest position, in which a different selector opening 23 covers the gas outlet channel 32 and is released, the spring 221 brings it (axially) back into the (new) working position. Analogously, a corresponding exhaust 24 of the rest element 20 comes into fluidic connection with the gas outlet channel 32, as a result of which the gas can escape toward the front.

The rotary movement in the circumferential direction is limited in the illustrated embodiment by the cam 223 coming up against stops 18 on the barrel 10; other limitations (or the omission thereof) can easily be determined with knowledge of the disclosure and the present application. The stops 18 can, for example, be designed as pins or else as integral parts of the band 172 protruding in the direction of the muzzle. The stopper notch 19 is preferably milled accordingly into the outer contour of the barrel 10, an alternative design of the flange-shaped band 172 as a separate component also being conceivable.

If the cross-sectional shape of the rest positions 17 is chosen to be different than what is shown, for example with rounded transitions to the end face between the rest positions 17, the axial movement can also take place when the selector 20 is rotated without specific pressure or tension counter to the barrel direction 91, toward the shaft.

Assembly/Disassembly

For complete disassembly, the selector 20 is rotated in the circumferential direction analogously to the previously described adjustment movement until the rest bolt 21 has passed the last rest position 17. Such a position is preferably defined on both sides in the circumferential direction by previously described stops 18 as a stop position; see FIG. 8. Subsequently, the plunger 22 is pushed forward in the axial direction and the spring 221 is compressed until the plunger 22 goes far enough in the direction of the muzzle that its cam 223 can be turned past the stop 18 when the selector 20 is turned within the stopper notch 19 and does not bump against it, which allows further turning into a disassembly position.

Figure 9B:
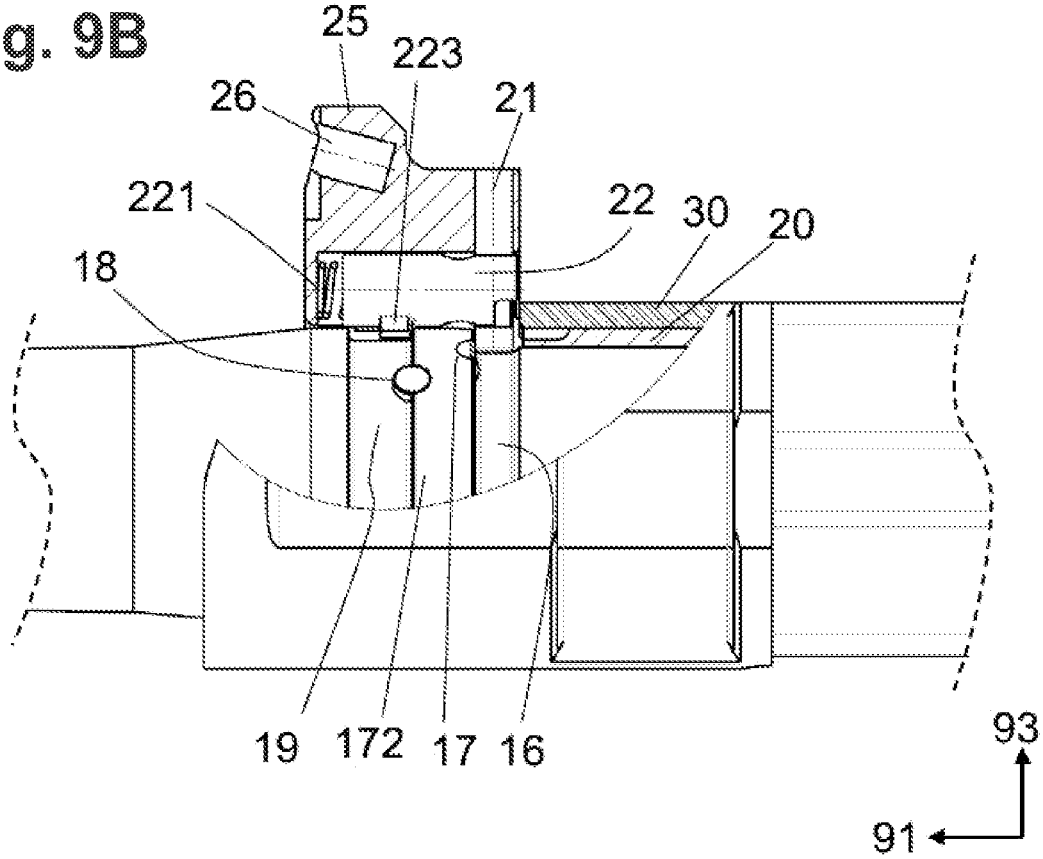

As shown in FIGS. 9A and 9B, in particular when viewed together with FIGS. 5 and 8B, this axial displacement of the selector 20 is made possible by the interaction of the slotted rest bolt receiver 224 with the flattening 212 of the rest bolt 21. The rest bolt receiver 224 is thus designed to be complementary in shape and function to the rest bolt 21 in order to at least partially receive the rest bolt 21 in the region of its flattening 212 when the plunger 22 is pushed forward.

To put it simply, for complete disassembly the selector 20 must first be pulled rearward counter to the barrel direction and rotated in the circumferential direction until the rest bolt 21 disengages from one of the rest positions 17, in order to then allow further rotation into the disassembly position by pressing on the plunger 22. In the disassembly position, the selector 20 together with the cam 223 can be pushed or pulled rearward, in the direction of the shaft, the cam 223 coming through the band 172 via an outlet groove running parallel to the axis of the barrel bore. The design and arrangement of this outlet groove on the band 172 is easy for a person skilled in the art with knowledge of the present disclosure to configure and to position accordingly in the peripheral direction. Likewise, for improved guidance of the rest bolt 21 in the axial direction to the rear, a rest notch 171 can be formed adjacent to the band 172 (see FIG. 6A).

In a preferred embodiment, the disassembly position is provided in such a way that the outlet groove for the cam 223 is advantageously designed to be aligned with the recess 14 when viewed in the barrel direction. Such an embodiment can be clearly seen in FIG. 4. This can result in particular manufacturing technology advantages by reducing the processing steps required.

In a further preferred embodiment, the disassembly position and, accordingly, the outlet groove for the cam 223 are formed offset 180° in the circumferential direction with respect to the central working position, whereby the symmetry of the components can be increased and thus an improved weight distribution can be achieved.

As described above, at least one labyrinth seal 12 or a seal having the same effect against the piston 30 must be formed on the barrel 10. This seal can be formed integrally on the barrel 10 or as a separate component, such as a slip-on sleeve. This can be clearly seen from FIG. 4 in conjunction with FIG. 1. Furthermore, the barrel 10 can have a radial thickening in the region of the gas extraction. It has proven to be advantageous that a circumferential sealing surface formed parallel to the axis of the barrel bore is formed adjacent to the labyrinth seal 12 in the barrel direction. Further in the barrel direction, the preferably circumferential gas gap 16 and adjoining it a further circumferential surface parallel to the barrel axis for contacting the selector 20 is formed in the region of the gas port(s) 15; see also FIGS. 2 and 3.

The rest notch 171 can be provided on this surface and, depending on the design of the rest position 17 and the rest bolt 21, can also be omitted. Seen further in the direction of the muzzle, a flange-shaped band 172 is to be provided which protrudes radially over the aforementioned surface and is delimited in the axial direction by the stopper notch 19. As can be seen particularly well in FIG. 4, a conical portion, which protrudes radially in the border region with respect to the stopper notch 19, is formed adjacent to the stopper notch 19 in the barrel direction. As can be seen in FIG. 4, the conical portion is at least partially opened in the barrel direction by the recess 14. Instead of a conical portion, a differently shaped portion, such as a radial step, can of course also be provided integrally or as a separate component, such as a sleeve or flange.

Further Embodiments

In addition to the variants, embodiments and further developments already mentioned in the text, the following should be specifically pointed out:

The overflow edge 31 can be designed and arranged in such a way that the expansion chamber 28 closes the gas flow to the outside (fluidic separation) before the shot is fired (piston in the stationary state, as shown in FIG. 2B with a different overflow edge). In the preferred example shown, however, the overflow edge 31 is arranged in such a way that there is also a fluidic connection before the shot is fired (FIG. 2B).

Figure 10A:
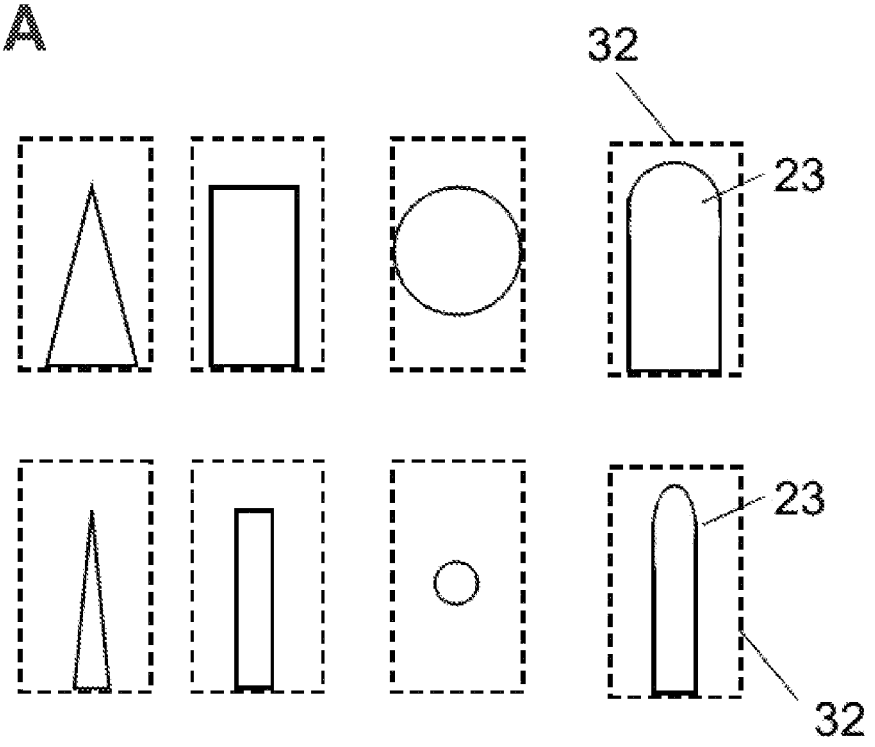
FIGS. 10A and 10B show various forms of alternative selector openings according to the present disclosure.
Figure 10B:
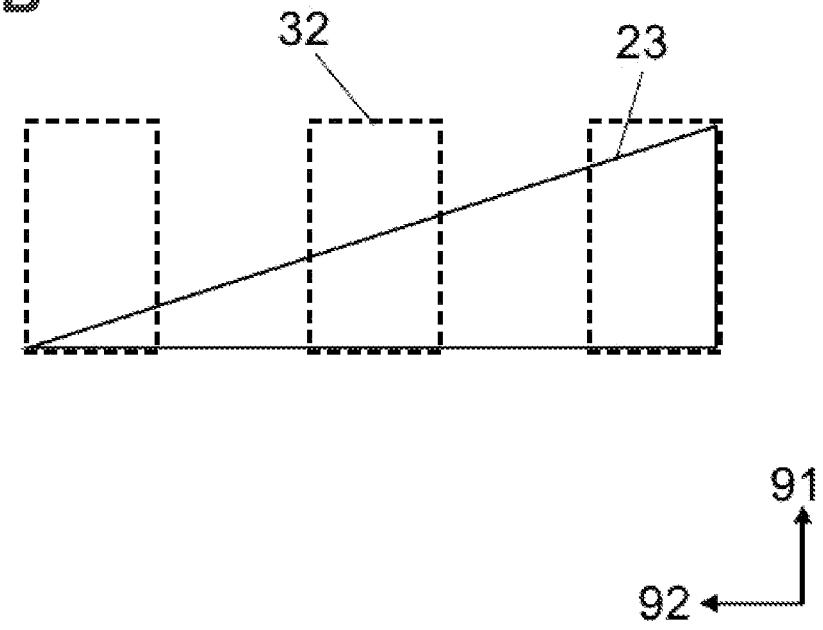

As shown in particular in FIG. 10A, the selector opening 23 can preferably be designed as a slot having different widths, possibly also lengths and contour shapes, and accordingly have different cross-sectional areas when viewed in the radial direction. Other variants are: holes of different sizes, U-shaped, V-shaped or rectangular incisions, or even a single, asymmetrical notch (e.g. right triangle; see FIG. 10B), which causes a cross section (=opening) of a different size to overlap with the gas outlet channel 32 (indicated by dashed squares) depending on the position of the gas selector 20.

It should be noted at this point that a correspondingly configured selector opening 23 with a correspondingly configured cross-sectional area is sufficient for the basic operation of the adjustable gas drive. Preferably, however, two or more, in particular, as shown, three selector openings 23 and the corresponding exhausts 24 are to be provided on the selector 20.

The operating rod assembly 40 can also be made in one piece, for example from extruded (polygonal) tube, or, preferably, as a stamped sheet metal part (as in the illustration; therefore the upper surface 40 is not hatched in FIGS. 2B and 3B, because the section runs through a joint). In the case of a stamped sheet metal part or bent part, the operating rod assembly 40 can thus be designed to be open in a vertical direction, upward or downward.

An operating element 25 is formed on the selector 20 in the region of the mechanism. This can have a blind hole 26 on the front, as shown in FIG. 8B, so that the selector 20, for example when it is hot after prolonged firing, can be displaced or adjusted axially and circumferentially with a simple (makeshift) tool, for example a cartridge tip.

On the piston 30, as is clearly shown, for example, in FIGS. 7 and 3B, an axial protrusion 37 can advantageously be formed, which better directs the gas flow toward the muzzle. Variants without such a protrusion are of course possible; the gas flow then goes into the environment directly after the gas outlet channel 32 as soon as a gap is formed between the piston 30 and the selector 30 when the piston 30 moves rearward.

Brief Summary of the Advantages Achieved According to the Present Disclosure, Including Those Based on Embodiments A relatively simple, adjustable gas system is presented, the adjustment of which is also possible in the hot state with the aid of a simple implement, such as a cartridge tip.

Parts of relatively large dimension reduce the likelihood of soiling, incrustation and wear, and make cleaning easier. The relatively large sealing surfaces and active surfaces, as well as the requirement for fewer, more robust parts, can increase operational reliability compared to the prior art, where very often very intricate parts with corresponding disadvantages are used.

The presented design allows for simple assembly and disassembly that is largely tool-free and does not require special tools. In addition, the design as a screwless system without easily soiled or damaged threads can contribute to increasing the service life.

On the basis of the above description, a person skilled in the art can relatively easily optimize the size, shape and number of the required components in order to obtain more than one presettable working position. The gas extraction can thus be relatively easily adapted, using the operating mode explained above, to the ammunition used, thus propellant charge, caliber, etc., as well as any muzzle attachments such as silencers, muzzle brakes and the like, as well as to external environmental influences such as extreme cold.

If the gas drive is designed in such a way that it therefore has no fluidic separation between surrounding environment and gas drive in the idle state as a connected system, as shown for example in FIG. 2, the gas pulse occurring when a shot is fired can be designed to be slightly slower compared to the fluidically separated system and thus be absorbed in a more protective manner from the shot because a "softer" pressure behavior of the piston 30 on the gas linkage 40 is achieved.

If the gas drive is designed as closed, the risk of liquid and/or foreign bodies entering the gas drive from the surrounding environment can be further reduced, which can also bring certain advantages in view of the often harsh operating conditions.

| List of reference signs: | |
|---|---|
| 10 | Barrel |
| 11 | Muzzle |
| 12 | Labyrinth seal |
| 14 | Recess |
| 15 | Gas port |
| 16 | Gas gap |
| 17 | Rest position |
| 171 | Rest notch |
| 172 | Band/flange |
| 18 | Stopper |
| 19 | Stopper notch |
| 20 | Selector |
| 21 | Rest bold |
| 211 | Rest bolt opening |
| 212 | Flattening |
| 22 | Plunger |
| 221 | Spring |
| 222 | Spring opening |
| 223 | Cam |
| 224 | Slotted rest bolt receiver |
| 23 | Selector opening |
| 24 | Exhaust |
| 25 | Operating element |
| 26 | Blind hole |
| 270 | Inner selector surface (seals against the barrel) |
| 271 | Outer selector surface (seals against the piston) |
| 272 | Step |
| 28 | Expansion chamber |
| 29 | End surface |
| 30 | Piston |
| 31 | Overflow edge |

-continued

| List of reference signs: | |
|---|---|
| 32 | Gas outlet channel |
| 33 | Ring surface (gas pressure applied) |
| 34 | Seal surface |
| 35 | Contact surface |
| 36 | Cylinder surface |
| 37 | Protrusion |
| 40 | Operating rod |
| 50 | Retaining spring |
| 60 | Barrel extension |
| 91 | Barrel direction-front |
| 92 | Transverse direction-left |
| 93 | Upward normal direction |

The invention claimed is:

1. A firearm, comprising:

a frame;

a barrel having a barrel axis, the barrel being fixedly mounted to the frame;

a barrel extension that is connectable to the barrel;

a breech having a sliding piece; and a gas drive configured to act on the sliding piece of the breech via one or more operating rods;

wherein the gas drive includes:

a selector, the selector being arranged on the barrel so as to be rotatable about the barrel;

an annular piston that is displaceably arranged on the barrel between a front resting position and a rear end position and which forms an expansion chamber, the expansion chamber being delimited by a ring surface and an inner cylinder surface of the annular piston, and an end surface of the selector and the barrel; where the annular piston is urged in a forward direction by one or more retaining springs; and at least one gas port defined in a wall of the barrel in a region of the expansion chamber;

wherein the selector is rotatable about the barrel axis into at least two predefined rest positions, in which for each of the at least two predefined rest positions a gas flow from the expansion chamber into an environment is delimitable by at least one selector opening defined by the selector and a gas outlet channel of the piston.

2. The firearm according to claim 1, wherein the selector has a rear portion and a front portion, the rear portion having a smaller diameter than the front portion;

when the piston is in the front resting position the piston is urged over the rear portion of the selector, and the at least one selector opening is provided on the rear portion of the selector to adjust the gas flow from the expansion chamber into the gas outlet channel of the piston, and the selector has at least one exhaust defined in a transition region to the front portion of the selector, the exhaust being configured to discharge the gas flow from the gas outlet channel.

3. The firearm according to claim 1, wherein the gas outlet channel of the piston is defined in the inner cylinder surface such that the gas outlet channel is delimited at its rear by an overflow edge.

4. The firearm according to claim 3, wherein the gas outlet channel is defined so as to extend in a circumferential direction in an angular range from 5° to 90° on the inner cylinder surface of the piston.

5. The firearm according to claim 3, wherein the gas outlet channel is defined so as to extend in a circumferential direction in an angular range from 10° to 30° on the inner cylinder surface of the piston.

6. The firearm according to claim 1, wherein the barrel includes a flange-shaped band having at least two rest positions.

7. The firearm according to claim 1, wherein a recess is defined in a surface of the barrel, the recess being defined as an elongated depression.

8. The firearm according to claim 1, wherein the selector defines a rest bolt opening that extends radially inward in a direction of the barrel, the rest bolt opening being configured to receive a rest bolt; and the selector defines a spring opening that is formed parallel to the barrel axis, such that an opening of the spring opening points rearward and is used for receiving a plunger and a spring acting on the plunger.

9. The firearm according to claim 8, wherein:

the plunger defines a slotted rest bolt receiver that is designed to receive and guide the rest bolt in an installation situation;

the rest bolt has a flattening on at least one side on a lateral surface of the rest bolt;

the rest bolt receiver defines a slot-shaped opening that extends rearwardly in a direction normal to the barrel axis from a hole configured to receive the rest bolt up to an end of the plunger and is designed in a transverse direction to match a diameter of the rest bolt in a region of its flattening; and the plunger has a protruding cam on a lower face.

10. The firearm according to claim 9, wherein a flange-shaped band of the barrel defines an adjoining stopper notch configured to receive and guide the cam on the lower face of the plunger.

11. The firearm according to claim 10, wherein at least one stopper for defining a stop position is formed within the stopper notch.

12. The firearm according to claim 9, further comprising a radially protruding operating element configured to receive the plunger, the spring, and the rest bolt; where the radially protruding operating element is formed on a front portion of the selector.

13. The firearm according to claim 8, wherein a length of the plunger is selected so that in a spring-loaded installation situation a rear region of the plunger protrudes 2 to 20 mm rearwards out of the spring opening.

14. The firearm according to claim 8, wherein a length of the plunger is selected so that in a spring-loaded installation situation a rear region of the plunger protrudes 5 to 10 mm rearwards out of the spring opening.

15. The firearm according to claim 1, wherein the at least one selector opening defined by the selector comprises at least two selector openings each having different cross-sectional areas.

16. The firearm according to claim 1, wherein the at least two predefined rest positions comprises at least three predefined rest positions and wherein the at least one selector opening comprises at least three selector openings, each of the at least three predefined rest positions having a corresponding selector opening of the at least three selector openings defined by the selector and the gas outlet channel of the piston, and the at least three selector openings have different cross-sectional areas.

17. The firearm according to claim 1, wherein a protrusion formed at a front portion of the piston at least partially circumferentially encases the selector.

18. The firearm according to claim 17, wherein the protrusion formed at the front portion of the piston circumferentially encases the selector over an arc of 90° that is centered on the gas outlet channel.

19. The firearm according to claim 17, wherein the protrusion formed at the front portion of the piston circumferentially encases the selector over an arc of 180° that is centered on the gas outlet channel.

20. The firearm according to claim 17, wherein the protrusion formed at the front portion of the piston circumferentially encases the selector over an arc of more than 180° that is centered on the gas outlet channel.

21. The firearm according to claim 1, wherein when the annular piston is in the front resting position, the expansion chamber is fluidically separated from the gas outlet channel.

22. The firearm according to claim 1, wherein when the annular piston is in the rear end position, the expansion chamber is fluidically connected to the gas outlet channel.

* * * * *